US007428395B2

(12) United States Patent
Takahashi et al.

(10) Patent No.: US 7,428,395 B2
(45) Date of Patent: Sep. 23, 2008

(54) IMAGE FORMING APPARATUS EQUIPPED WITH DEVELOPING UNIT TO MAKE DEVELOPING AND SIMULTANEOUS CLEANING AND IMAGE FORMING METHOD

(75) Inventors: Masashi Takahashi, Kanagawa-ken (JP); Minoru Yoshida, Tokyo (JP); Takeshi Watanabe, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/085,004

(22) Filed: Mar. 21, 2005

(65) Prior Publication Data

US 2006/0210310 A1 Sep. 21, 2006

(51) Int. Cl.
*G03G 15/30* (2006.01)

(52) U.S. Cl. ..... 399/149; 399/150

(58) Field of Classification Search ..... 399/149, 399/150

See application file for complete search history.

(56) References Cited

U.S. PATENT DOCUMENTS

| | | | | |
|---|---|---|---|---|
| 5,227,851 | A | 7/1993 | Yoshida et al. | |
| 5,317,370 | A | 5/1994 | Kohyama et al. | |
| 5,436,700 | A | 7/1995 | Kikuchi et al. | |
| 5,612,775 | A * | 3/1997 | Nagaoka | 399/345 |
| 5,652,649 | A * | 7/1997 | Ikegawa et al. | 399/175 |
| 5,669,055 | A * | 9/1997 | Thayer et al. | 399/345 |
| 5,797,078 | A * | 8/1998 | Sass et al. | 399/357 |
| 6,219,505 | B1 | 4/2001 | Sato et al. | |
| 6,381,427 | B1 * | 4/2002 | Bertram et al. | 399/101 |
| 6,408,154 | B1 * | 6/2002 | Fotland et al. | 399/296 |
| 6,415,119 | B2 | 7/2002 | Nishimura et al. | |
| 6,865,357 | B2 * | 3/2005 | Fujita et al. | 399/111 |
| 6,928,253 | B2 * | 8/2005 | Ojima et al. | 399/129 |
| 2002/0034397 | A1 * | 3/2002 | Shimizu et al. | 399/100 |
| 2004/0179880 | A1 | 9/2004 | Takahashi et al. | |
| 2004/0228657 | A1 | 11/2004 | Takahashi et al. | |

FOREIGN PATENT DOCUMENTS

| | | | |
|---|---|---|---|
| JP | 5-61383 | A | 3/1993 |
| JP | 2000-181309 | A | 6/2000 |
| JP | 2000-206850 | A | 7/2000 |
| JP | 2004-45568 | A | 2/2004 |

* cited by examiner

*Primary Examiner*—Quana M Grainger
(74) *Attorney, Agent, or Firm*—Foley & Lardner LLP

(57) ABSTRACT

In an image forming apparatus using simultaneous developing and cleaning type developing units, this invention installs brush members to disturb toners remaining on photosensitive drums movably in the direction to contact with photosensitive drums corresponding to the displacement of the surfaces of the photosensitive drums by empty weights and keep the ends of the brush members always in contact with the photosensitive drums.

22 Claims, 7 Drawing Sheets

TABLE 1

| | BRUSH MATERIAL | YOUNG'S MODULUS ($N/mm^2$) | FINENESS (DENIER) | DENSITY | LIFE TEST RESULTS (FILMING EVALUATION) |
|---|---|---|---|---|---|
| TEST EXAMPLE 1 | ACRYLIC | 1,500-3,350 | 6 | 100kF | ○ |
| TEST EXAMPLE 2 | POLYESTER | 3,100-3,700 | 6 | 100kF | ○ |
| COMPARISON EXAMPLE 1 | NYLON | 1,000-1,700 | 6 | 100kF | × |
| COMPARISON EXAMPLE 2 | VINYLON | 7,500 | 6 | 100kF | OCCURRENCE OF WHITE STREAKS |

IMAGE FORMING APPARATUS EQUIPPED WITH DEVELOPING UNIT TO MAKE DEVELOPING AND SIMULTANEOUS CLEANING AND IMAGE FORMING METHOD

BACKGROUND OF THE INVENTION

1. Field of the Invention

The present invention relates to an image forming apparatus equipped with a developing unit to make the developing and simultaneous cleaning for electro-photographic type copiers, printer and the like and an image forming method.

2. Description of the Related Art

In recent year, among image forming apparatus such as copying machines, printers, etc., there is an image forming apparatus adopting less cleaner type developing units without scraping toners remaining on photosensitive drums with a blade, etc. after transferring images and recover toners simultaneously with development in the subsequent image forming process. Such image forming apparatus prevents abrasion of photosensitive drums and is able to use toners by recycling.

However, in a cleaner-less type image forming apparatus, it tends to generate the state that toners always remain on the same portions of photosensitive drums. Therefore, when the image forming process is repeatedly conducted using this cleaner-less type image forming apparatus, a so-called filming phenomenon where toners remaining for a long time are firmly fixed on the surfaces of photosensitive drum is generated. When the filming phenomenon is generated, voids are produced on toner images and the image quality drops.

So, for example, in the Japanese Patent Application Publication No. 05-61383, an apparatus to prevent the filming by erasing image memories on the surfaces of photosensitive drums after completing the image transfer using vibrating or oscillating brushes is disclosed. Further, in the Japanese Patent Application Publication No. 2000-181309, an apparatus to prevent the filming by removing paper-dust on the surfaces of photosensitive drums after completing the transfer by rotating paper-dust removing rollers equipped with brushes is disclosed.

However, in the conventional apparatus described above, all of brushes are attached to mounting shafts and vibrate, oscillate or rotate centering around the attached shaft. On the other hand, for manufacturing accuracy or assembling accuracy of the photosensitive drums, it is difficult to hold the surface positions of the photosensitive drum constant and the surface positions are displaced. When the surface positions of the photosensitive drums are displaced, the filming preventive brushes are pushed and bent by such a surface position displacement, so that ends of the brushes are not in sufficient contact with the surfaces of the photosensitive drums but bent portions other than the ends of the brushes come into contact with them, which are hereinafter collectively called "bent-portion contacts" of the brushes. As a result, the brushing effect is reduced remarkably and the filming preventive effect is lowered.

So, in the field of image forming apparatus adopting a cleaner-less system, an image forming apparatus and an image forming method capable of getting the high-grade image quality by effectively erasing image memories remaining on photosensitive drums using brushes and surely preventing the filming phenomenon after transferring images are demanded.

SUMMARY OF THE INVENTION

An object of this invention is to get high-grade image quality without voids by erasing image memories by keeping the ends of brushes always in contact with photosensitive drum surfaces irrespective of the displacement of the photosensitive drum surfaces.

According to the embodiments of this invention, the image forming apparatus of this invention is characterized in that it has image carriers, latent image forming units to form electrostatic latent images on the image carriers, developing units to perform the simultaneous developing and cleaning of the electrostatic latent images formed on the image carriers, transferring units to transfer toner images formed on the image carriers on recording media, brush members to disturb image memories by bringing their ends in contact with the surfaces of the image carriers having residual toners thereon after the ends have passed the transferring units; and position adjusting units to adjust the displacement of the brush members in the direction to contact with the image carrier surfaces.

DETAILED DESCRIPTION OF THE INVENTION

Figure 1:
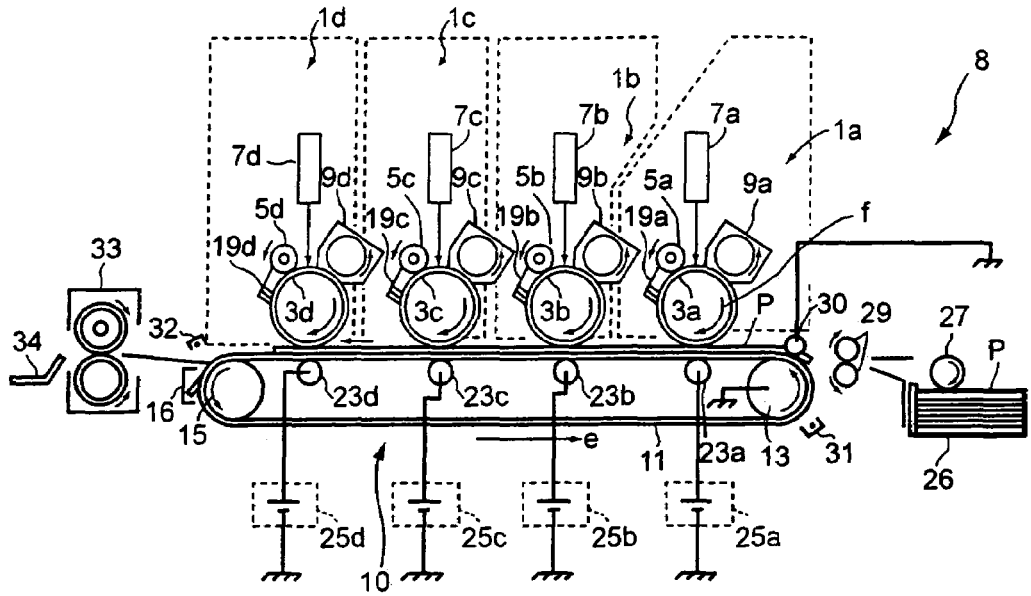
FIG. 1 is a schematic construction diagram showing a printer in the first embodiment of this invention.

A first embodiment of this invention will be described below in detail referring to the attached drawings. FIG. 1 is a schematic construction diagram showing a quadruple tandem type printer 8 that is an image forming apparatus in the first embodiment of this invention. Printer 8 has yellow (Y), magenta (M), cyan (C) and black (BK) processing units 1*a*, 1*b*, 1*c* and 1*d* to transfer and form yellow (Y), magenta (M), cyan (C) and black (BK) toner images on a sheet of paper which is a recording medium, along a transfer belt 11 composing a transfer unit that is rotated in the arrow direction e.

Processing units 1*a*, 1*b*, 1*c* and 1*d* have photosensitive drums 3*a*, 3*b*, 3*c* and 3*d*, which are image carriers and form toner images in different developing agents on respective photosensitive drums 3*a*, 3*b*, 3*c* and 3*d*. Processing units 1*a*, 1*b*, 1*c* and 1*d* form images in different color developers; yellow (Y), magenta (M), cyan (C) and black (BK); however, they are all in the same structure and therefore, the yellow (Y) processing unit 1*a* will be described as a representative unit and the same reference numerals with respective subscripts will be assigned to the same component elements of other processing units 1*b*, 1*c*, 1*d* and explanations thereof will be omitted.

Photosensitive drum 3*a* is formed in a cylindrical shape 30 mm in diameter and a main charger 5*a* and an exposure unit 7*a* that comprise a latent image forming unit are arranged along the arrow f rotating direction around photosensitive drum 3*a*. Main charger 5*a* is composed of a conductive roller and uniformly charges photosensitive drum 3*a* to about −600V. Main charger 5*a* can be a conductive brush, a blade, etc. At the downstream side of exposure unit 7*a* around photosensitive drum 3*a*, a developing unit 9*a* is provided to perform the simultaneous developing and cleaning on photosensitive drum 3*a* using two-component developing agent comprising yellow (Y) toner and carrier. At the downstream side of developing unit 9*a*, a transfer unit 10 is provided to transfer a toner image formed on photosensitive drum 3*a* on a sheet of paper P.

Transfer unit 10 is provided with a transfer belt 11 and a conductive transfer roller 23*a* to apply bias through the back of transfer belt 11 from a DC power source 25*a*. Transfer roller 23*a* is formed in a conductive urethane foam roller in 19 mm outer diameter that is made electrically conductive by dispersing carbon to a core metal in 10 mm diameter. Electric resistance between the core metal and the surface of the urethane foam roller is about 10e6 Ω.

In processing units 1*a*, 1*b*, 1*c* and 1*d*, bias value applied to transfer rollers 23*a*, 23*b*, 23*c* and 23*d* from DC power sources 25*a*, 25*b*, 25*c* and 25*d* become high every time when toner images are superposed on each other on a sheet of paper. Bias value is set at +1000V for yellow (Y) transfer roller 23*a*, +1200V for magenta (M) transfer roller 23*b*, +1400V for cyan (C) transfer roller 23*c* and +1600V for black (BK) transfer roller 23*d*.

Transfer belt 11 is formed by 100 μm thick polyimide in with carbon dispersed uniformly. Transfer belt shows semiconductivity of volume resistance $10^{-10}$ Ωcm. A material that shows semiconductivity of $10^{-8}$ to $10^{-13}$ Ωcm can be used for transfer belt 11. For example, polyethylene terephthalate, polycarbonate, polytetrafluoroethylene, polyvinilidene-fluoride, etc. with conductive particles such as carbon, etc. dispersed are usable. Further, macromolecular film with ion conductive material mixed or such rubber materials as silicon rubber, urethane rubber, etc. having relatively low electric resistance may be used.

Transfer belt 11 has a width almost equal to the length of photosensitive drum 3*a*. Transfer belt 11 is put over driving roller 15 and idle roller 13 that are arranged at a space of 300 mm. In the vicinity of transfer belt 11, a corona charger 31 to charge the transfer belt in order for electrostatically adsorbing a sheet of paper P, a grounded metal roller 30 for electrostatically adsorbing a sheet of paper P to transfer belt 11, a separation charger 32 for separating a sheet of paper P and a transfer belt cleaner 16 are arranged.

In the vicinity of photosensitive drum 3*a*, at the downstream side of transfer unit 10, a memory disturbing brush 19*a* to disturb a toner image that is an image memory and an electrostatic latent image remaining on photosensitive drum 3*a* is provided.

Further, in the conveying direction of sheets of paper P, a paper supply cassette unit 26 to house sheets of paper is provided at the upper stream of transfer belt 11. Between paper supply cassette unit 26 and transfer belt 11, a pick-up roller 27 to take out a sheet of paper and an aligning roller 29 to supply a sheet of paper in the direction of transfer belt 11 at a specified timing after having the sheet of paper wait are provided. At the downstream of transfer belt 11, a fixing unit 33 and a paper discharging tray 34 are arranged.

Next, memory disturbing brushes 19*a*, 19*b*, 19*c* and 19*d* will be described in detail. Memory disturbing brushes 19*a*, 29*b*, 19*c* and 19*d* are composed of brush mounting jigs 41*a*, 41*b*, 41*c* and 41*d* that are position adjusting means to rotate using shafts 40*a*, 40*b*, 40*c* and 40*d* as supporting points and brush members 42*a*, 42*b*, 42*c* and 42*d* that contact with photosensitive drums 3*a*, 3*b*, 3*c* and 3*d*. Brush members 42*a*, 42*b*, 42*c* and 42*d* are composed of, for example, a 1.5 mm thick metal plate with a conductive cloth woven with acrylic fabric in 6 denier (about 25 μm diameter) thick in 100 kF density (the number of filaments per unit area) adhered and cut into a length 5 mm. Young's modulus expressing the toughness of acrylic fabric is 1,500 to 3,350 (N/mm$^2$).

Brush mounting jigs 41*a*, 41*b*, 41*c* and 41*d* are turned so as to keep the ends of acrylic fibers of brush members 42*a*, 42*b*, 42*c* and 42*d* always in contact with photosensitive drums 3*a*, 3*b*, 3*c* and 3*d* by the whole empty weight of memory disturbing brushes 19*a*, 19*b*, 19*c* and 19*d*. That is, brush mounting jigs 41*a*, 41*b*, 41*c* and 41*d* are oscillated corresponding to displacement of the surfaces of photosensitive drums 3*a*, 3*b*, 3*c* and 3*d*. As a result, brush members 42*a*, 42*b*, 42*c* and 42*d* are displaced in the direction to contact with photosensitive drums 3*a*, 3*b*, 3*c* and 3*d* according to the displacement of the surfaces of photosensitive drums 3*a*, 3*b*, 3*c* and 3*d*. Accordingly, the ends of acrylic fibers are always kept in contact with photosensitive drums 3*a*, 3*b*, 3*c* and 3*d* without causing, what is called, "bent-portion contacts" that is, the portions of other than the ends of acrylic fiber of brush members 42*a*, 42*b*, 42*c* and 42*d* contact with photosensitive drums 3*a*, 3*b*, 3*c* and 3*d*. Empty weight means the weight of the main part except an add-on, a loading thing, etc., that is, one's own weight. For example, the empty weight of the memory disturbing brush 19*a* includes the weight of the brush mounting jig 41*a* and the brush member 42*a* except the shaft 40*a*.

Next, the operations will be described. When the image forming process starts, image data is input to printer 8 from a scanner or a PC terminal, etc. and the image forming process is carried out by process units 1*a*, 1*b*, 1*c* and 1*d*, respectively. Photosensitive drums 3*a*, 3*b*, 3*c* and 3*d* are rotated in the arrow direction f. Transfer belt 11 is rotated in the arrow direction e.

Photosensitive drums 3*a*, 3*b*, 3*c* and 3*d* are charged to −600V uniformly by main chargers 5*a*, 5*b*, 5*c* and 5*d*, respectively. Then, photosensitive drums 3*a*, 3*b*, 3*c* and 3*d* are applied with exposure light corresponding to image data in respective colors by exposure units 7*a*, 7*b*, 7*c* and 7*d* and electrostatic latent images are formed. Then, developing units 9*a*, 9*b*, 9*c* and 9*d* develop toner images by supplying toners to the exposure portions of the electrostatic latent images on photosensitive drums 3*a*, 3*b*, 3*c* and 3*d* and at the same time, recover toners supplied to photosensitive drums 3*a*, 3*b*, 3*c* and 3*d* in the preceding image forming process and remained on the non-exposure portions of the photosensitive drums in developing units 9*a*, 9*b*, 9*c* and 9*d* and conduct the simultaneous developing and cleaning.

During this time, a sheet of paper P is taken out of paper supply cassette unit 26 by pick-up roller 27. Then, the sheet of paper P is supplied on transfer belt 11 in sync with toner images on photosensitive drums 3*a*, 3*b*, 3*c* and 3*d* at a specified timing by aligning roller 29.

While conveyed on transfer belt 11 and passing through photosensitive drums 3*a*, 3*b*, 3*c* and 3*d*, a sheet of paper P is applied with transfer bias by transfer rollers 23*a*, 23*b*, 23*c* and 23*d* and toner images in respective colors are transferred and a full-color toner image with toner images in yellow (Y), magenta (M), cyan (C) and black (BK) toner images superposed each other is formed. A sheet of paper P with a full-color image formed is separated from transfer belt 11 by separation charger 32 and after fixed in fixing unit 33, is discharged on discharging tray 34.

Figure 2:
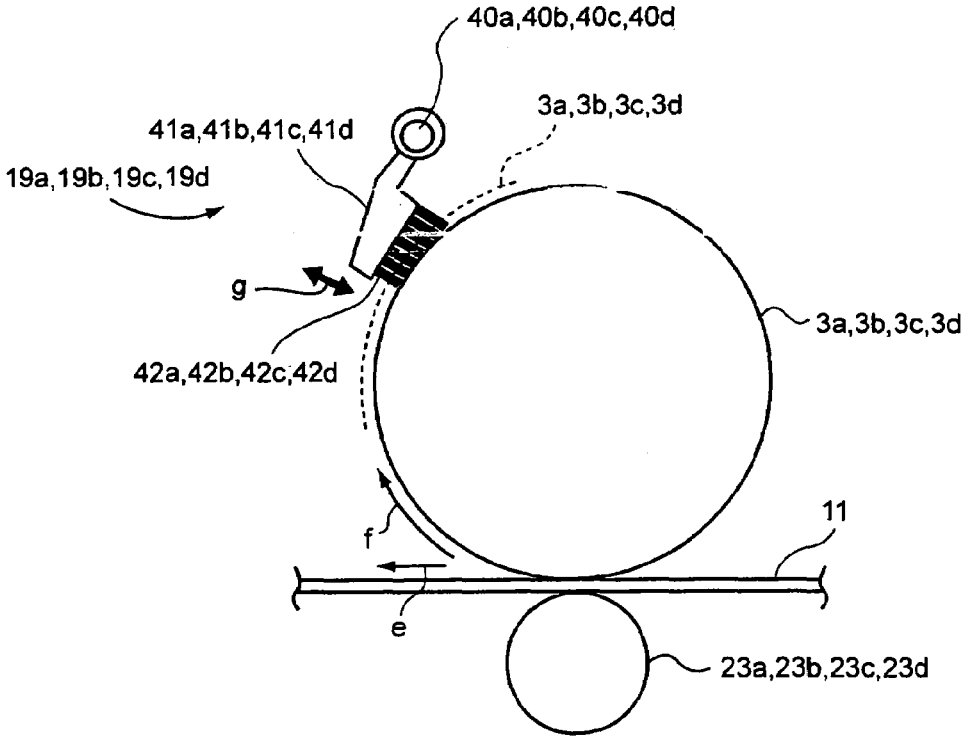
FIG. 2 is a schematic construction diagram showing a memory disturbing brush in the first embodiment of this invention.

On the other hand, after transferring toner images on a sheet of paper P, photosensitive drums 3*a*, 3*b*, 3*c* and 3*d* pass the positions of memory disturbing brushes 19*a*, 19*b*, 19*c* and 19*d*. At this time, the ends of brush members 42*a*, 42*b*, 42*c* and 42*d* are in contact with photosensitive drums 3*a*, 3*b*, 3*c* and 3*d* by the empty weight of memory disturbing brushes 19*a*, 19*b*, 19*c* and 19*d*. Accordingly, when, for example, the surfaces of photosensitive drums 3*a*, 3*b*, 3*c* and 3*d* are displaced to the positions shown by the dotted line from the position shown by the solid line in FIG. 2, brush mounting jigs 41*a*, 41*b*, 41*c* and 41*d* are turned in the arrow direction g in response to the displacement of the surfaces of photosensitive drums 3*a*, 3*b*, 3*c* and 3*d* with the shafts 40*a*, 40*b*, 40*c* and 40*d* as the supporting points.

As a result, the ends of acrylic fabric of brush members 42*a*, 42*b*, 42*c* and 42*d* are always kept in contact with photosensitive drums 3*a*, 3*b*, 3*c* and 3*d* without causing the "bent-portion contacts" of acrylic fiber. Accordingly, while photosensitive drums 3*a*, 3*b*, 3*c* and 3*d* are passing the memory disturbing brushes 19*a*, 19*b*, 19*c* and 19*d* positions, remaining transfer toners are certainly disturbed by the brushing effect of the ends of brush members 42*a*, 42*b*, 42*c* and 42*d*. Thereafter, the next image forming process is conducted on photosensitive drums 3*a*, 3*b*, 3*c* and 3*d*. That is, the next charging process and the exposure process are made on the photosensitive drums 3*a*, 3*b*, 3*c* and 3*d* in the state with disturbed transfer toners remained, a new electrostatic latent image is formed, and respective photosensitive drums reach developing units 9*a*, 9*b*, 9*c* and 9*d*. Developing units 9*a*, 9*b*, 9*c* and 9*d* form an electrostatic latent image on respective photosensitive drums 3*a*, 3*b*, 3*c* and 3*d* by supplying toners and at the same time, recover remaining toners adhered on the non-exposure portions and conduct the simultaneous developing and cleaning operation. At this time, transfer toners remained on photosensitive drums 3*a*, 3*b*, 3*c* and 3*d* were sufficiently disturbed by the ends of brush members 42*a*, 42*b*, 42*c* and 42*d*, the image structure was lost and adjusted to the easily recovered charge and therefore, developing units 9*a*, 9*b*, 9*c* and 9*d* are satisfactorily cleaned.

Remaining toners recovered in developing units 9*a*, 9*b*, 9*c* and 9*d* are reused directly. Then, after completing the specified image forming process, photosensitive drums 3*a*, 3*b*, 3*c* and 3*d* are rotated again and the toners remaining on photosensitive drums 3*a*, 3*b*, 3*c* and 3*d* are all recovered in developing units 9*a*, 9*b*, 9*c* and 9*d*.

Figures 3, 4:
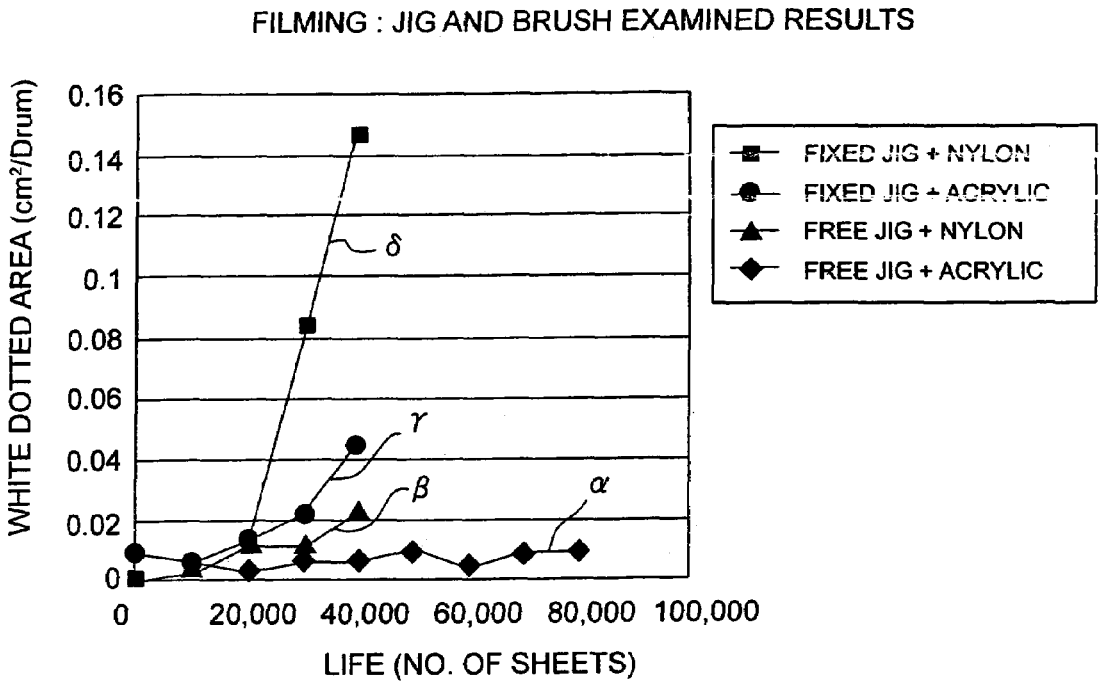
FIG. 3 is a table showing the results of a first life test in the first embodiment of this invention.
FIG. 4 is a graph showing the results of a second life test.

Then, the first life test of the filming preventing effect was conducted. The life test was conducted by changing acrylic fabric of memory disturbing brushes 19*a*, 19*b*, 19*c* and 19*d* and brush members 42*a*, 42*b*, 42*c* and 42*d* to nylon fabric, polyester fabric and vinylon fabric. The test results will be described referring to Table 1 shown in FIG. 3. In (Test Example 1) using brush members comprising acrylic fabric of Young's modulus 1,500 to 3,350 (N/mm$^2$) in this embodiment, the filming phenomenon is not solely recognized on the surfaces of photosensitive drums 3*a*, 3*b*, 3*c* and 3*d* even after the life test of 80,000 sheets conducted and good images without voids could be obtained. Next, in (Test Example 2) using brush members made of polyester fabric of Young's modulus 3,100 to 3 m, 700 (N/mm$^2$), the filming phenomenon was also not recognized likewise (Test Example 1).

On the other hand, when brush members made of nylon fabric of Young's modulus 1,000 to 1,700 (N/mm$^2$) was used in (Comparison Example 1), the filming phenomenon was observed and voids were recognized on images on the surfaces of photosensitive drums 3*a*, 3*b*, 3*c* and 3*d* at about 40,000 sheets. This is because the ends of brush members were not brought in contact with photosensitive drums 3*a*, 3*b*, 3*c* and 3*d*, causing the "bent-portion contacts" and the brush effect was reduced for low Young's modulus of nylon fabric and weak toughness of brush members.

Further, when brush members made of vinylon fabric of Young's modulus 7,500 (N/mm$^2$) were used in (Comparison Example 2), brush members were too tough and streak flaws were generated on the surfaces of photosensitive drums 3*a*, 3*b*, 3*c* and 3*d* and white streaks were produced on images from 30,000 to 40,000 sheets.

Further, a second life test of the filming preventing effect was conducted. The life test was conducted twice; that is; when acrylic fabric of memory disturbing brushes 19*a*, 19*b*, 19*c* and 19*d* and brush members 42*a*, 42*b*, 42*c* and 42*d* in this embodiment were changed to nylon fabric and when a conventional apparatus was used by fixing and arranged the brush members in the contacting direction. The results will be described referring to Graph 1 shown in FIG. 4. In (Test Example 1) using the brush members made of the acrylic fiber in this embodiment, the filming was not at all observed on the surfaces of photosensitive drums 3*a*, 3*b*, 3*c* and 3*d* even after the life test of 80,000 sheets as shown by the solid line a and a white dotted area on the image is below 0.01 (cm$^2$/Drum). On the other hand, in (Comparison Example 1) wherein the brush members can be replaced in the direction to contact with photosensitive drum 11 bad nylon fabric was used for the brush members, the filming phenomenon was slight generated on the surfaces of photosensitive drums 3*a*, 3*b*, 3*c* and 3*d* and the white dotted area on the image went up to 0.02 (cm$^2$/Drum) at the time when the life test of 40,000 sheets was conducted as shown by the solid line β.

Further, acrylic fabric was used for the brush members and the brush members were arranged and fixed in the direction to contact with photosensitive drum 11 (Comparison Example 3). In (Comparison Example 3), the filming phenomenon was generated almost twice of that in (Comparison Example 1) on the surfaces of photosensitive drums 3*a*, 3*b*, 3*c* and 3*d* and the white dotted area on the image went up to 0.04 (cm$^2$/Drum) at the time when the life test of 40,000 sheets was conducted. This is due to the decrease of brush effect caused by the "bent-portion contacts" of the brush members for the fixing of the brush members.

Further, nylon fabric was used for the brush members and the brush members were fixed and arranged in the direction to contact with photosensitive drum 11 (Comparison Example 4). In (Comparison Example 4), the filming phenomenon on the surfaces of photosensitive drums 3*a*, 3*b*, 3*c* and 3*d* increased rapidly at the time when exceeding 20,000 sheets, and the white dotted area on the image went up to 0.08 (cm$^2$/Drum) at the time when exceeding 30,000 sheets and the white dotted area on the images exceeded 0.14 (cm$^2$/

Drum) at the time when exceeded 40,000 sheets. This is due to the fact that the brush members were fixed, the toughness of the brush members were weak and the brushing effect by the ends of brush members was hardly obtained. According to this embodiment, brush mounting jigs 41*a*, 41*b*, 41*d* and 41*d* are rotatable with the shafts 40*a*, 40*b*, 40*c* and 40*d* as supporting points by the empty weights of memory disturbing brushes 19*a*, 19*b*, 19*c* and 19*d*. Thus, corresponding to the displacement of the surfaces of photosensitive drums 3*a*, 3*b*, 3*c* and 3*d*, brush members 42*a*, 42*b*, 42*c* and 42*d* are displaced so that the ends of the acrylic fiber are kept always in contact with photosensitive drums 3*a*, 3*b*, 3*c* and 3*d*. Accordingly, the image structure can be surely disturbed by brushing the remaining toners on photosensitive drums 3*a*, 3*b*, 3*c* and 3*d* thoroughly by the ends of brush members 42*a*, 42*b*, 42*c* and 42*d*. That is, because the toners remaining on the surfaces of photosensitive drums 3*a*, 3*b*, 3*c* and 3*d* are disturbed effectively, the generation of the filming phenomenon of the toners remained for a long time and hardened at the same positions of photosensitive drums 3*a*, 3*b*, 3*c* and 3*d* can be surely prevented and high grade toner images without void are obtained.

Next, a second embodiment of this invention will be explained. In this second embodiment, the arranging positions of the memory disturbing brushes differ from the first embodiment and bias is applied to the transfer belt by the conductive brushes of the transfer units and all others are the same as those in the first embodiment. Accordingly, in this second embodiment, the same structural elements as those explained in the first embodiment will be assigned with the same reference numerals and the detailed explanations thereof will be omitted.

Figure 5:
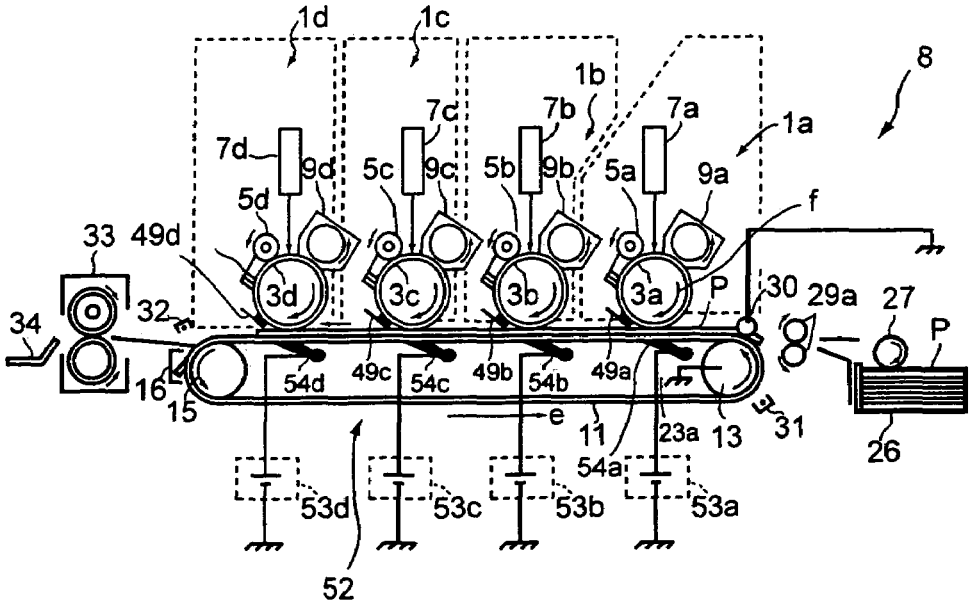
FIG. 5 is a schematic construction diagram of a printer in the second embodiment of this invention.
Figure 6:
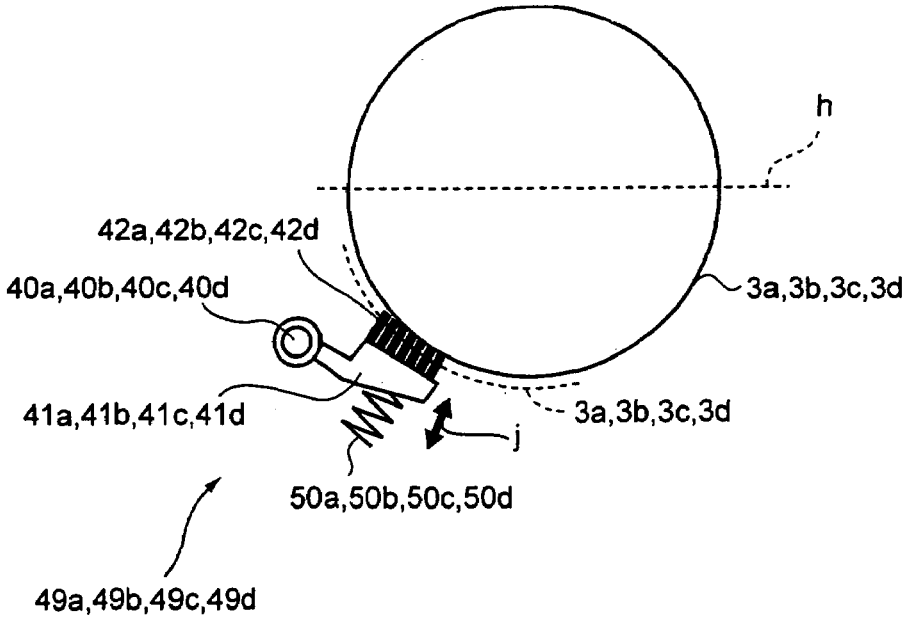
FIG. 6 is a schematic construction diagram of a memory disturbing brush in the second embodiment of this invention.

Memory disturbing brushes 49*a*, 49*b*, 49*c* and 49*d* are composed of the same brush mounting jigs 41*a*, 41*b*, 41*c* and 41*d* and brush members 42*a*, 42*b*, 42*c* and 42*d* as those in the first embodiment. However, memory disturbing brushes 49*a*, 49*b*, 49*c* and 49*d* are arranged below the horizontal line h passing through the center of rotation of photosensitive drums as shown in FIG. 5 and FIG. 6. Because of this, springs 50*a*, 50*b*, 50*c* and 50*d* are provided to bring the ends of brush members 42*a*, 42*b*, 42*c* and 42*d* to contact with photosensitive drums 3*a*, 3*b*, 3*c* and 3*d* at the weight almost same the empty weight of memory disturbing brushes 49*a*, 49*b*, 49*c* and 49*d*. Springs 50*a*, 50*b*, 50*c* and 5-*d* compress brush mounting jigs 41*a*, 41*b*, 41*c* and 41*d* in the direction of photosensitive drums 3*a*, 3*b*, 3*c* and 3*d*.

Accordingly, in the image forming process, when the surfaces of photosensitive drums 3*a*, 3*b*, 3*c* and 3*d* are displaced to the positions shown by the dotted line from the positions shown by the solid line when disturbing the toners remaining on photosensitive drums 3*a*, 3*b*, 3*c* and 3*d*, brush mounting jigs 41*a*, 41*b*, 41*c* and 41*d* turn in the arrow direction j according to the displacement of the surfaces of photosensitive drums 3*a*, 3*b*, 3*c* and 3*d* against the compressing force of springs 50*a*, 50*b*, 50*c* and 50*d* with shafts 40*a*, 40*b*, 40*c* and 40*d* as the supporting points.

Thus, brush members 42*a*, 42*b*, 42*c* and 42*d* keep the ends in contact with photosensitive drums 3*a*, 3*b*, 3*c* and 3*d* without causing the "bent-portion contacts" of the acrylic fabrics. Accordingly, the toners remaining after the transfer are thoroughly disturbed by the brushing effect of the ends of brush members 42*a*, 42*b*, 42*c* and 42*d* while photosensitive drums 3*a*, 3*b*, 3*c* and 3*d* pass through the positions of memory disturbing brushes 49*a*, 49*b*, 49*c* and 49*d*.

Figure 7:
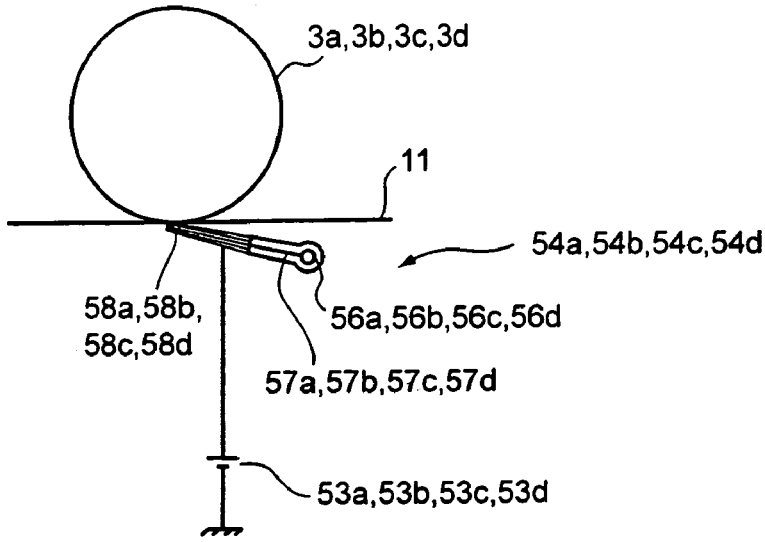
FIG. 7 is a schematic construction diagram showing a part of a transfer unit in the second embodiment of this invention.

Further, as shown in FIG. 5 and FIG. 7, transfer unit 52 in this embodiment has transfer belt 11 and conductive transfer brushes 54*a*, 54*b*, 54*c* and 54*d* apply bias from the backside of transfer belt 11. 800 to 2,000V is applied to transfer brushes 54*a*, 54*b*, 54*c* and 54*d* from DC power sources 53*a*, 53*b*, 53*c* and 53*d*. As a result of application of bias from transfer brushes 54*a*, 54*b*, 54*c* and 54*d*, a sheet P is charged to 400 to 800V through the backside, and toner images formed on photosensitive drums 3*a*, 3*b*, 3*c* and 3*d* are transferred to the sheet of paper P.

Transfer brushes 54*a*, 54*b*, 54*c* and 54*d* are composed of support members 57*a*, 57*b*, 57*c* and 57*d* made of metallic conductive materials installed with brush shaped portions 58*a*, 58*b*, 58*c* and 58*d* of bundled in the plate shape conductive fibers of rayon with conductive carbon mixed and kneaded. Transfer brushes 54*a*, 54*b*, 54*c* and 54*d* are installed rotatably to supporting shafts 56*a*, 56*b*, 56*c* and 56*d*.

When the length of fabric of brush portions 58*a*, 58*b*, 58*c* and 58*d* is in a range of 3 to 30 mm, fabrics in 1 to 8 denier moderately flexible are mechanically favorable. Electric resistance per fiber shows a good transfer characteristic in a range of $10^5$~$10^9$ Ω/mm. Further, when the fabric length of brush portions 58*a*, 58*b*, 58*c* and 58*d* is in a range of 20 to 30 mm, fabrics in about 5 to 15 denier are adequate.

Good images without transfer voids can be obtained by adjusting the mounting angle of support members 57*a*, 57*b*, 57*c* and 57*d* to support shafts 56*a*. 56*b*, 56*c* and 56*d* of transfer brushes 54*a*, 54*b*, 54*c* and 54*d* or the length and furthermore, planting density of brush fabrics.

According to this embodiment, the ends of brush members 42*a*, 42*b*, 42*c* and 42*d* are brought in contact with photosensitive drums 3*a*, 3*b*, 3*c* and 3*d* at the almost same weight as the empty weight by pressing memory disturbing brushes 49*a*, 49*b*, 49*c* and 49*d* with springs 50*a*, 50*b*, 50*c* and 50*d*. Thus, corresponding to the displacement of the surfaces of photosensitive drums 3*a*, 3*b*, 3*c* and 3*d*, the ends of the acrylic fabric are always kept in contact with photosensitive drums 3*a*, 3*b*, 3*c* and 3*d* by displacing brush members 42*a*, 42*b*, 42*c* and 42*b*. Accordingly, it is possible to thoroughly disturb transfer remaining toners by brushing the ends of brush member, preventing generation of filming phenomenon and obtain high grade toner images without voids.

Further, according to this embodiment, transfer belt 11 is applied with bias by transfer brushes 54*a*, 54*b*, 54*c* and 54*d*. As a result, it becomes possible to make the pressing force to photosensitive drums 3*a*, 3*b*, 3*c* and 3*d* at the transfer positions smaller than the transfer roller in the first embodiment. Accordingly, for example, when carriers are adhered to photosensitive drums 3*a*, 3*b*, 3*c* and 3*d*, it becomes possible to prevent the generation of flaws on the surfaces of photosensitive drums 3*a*, 3*b*, 3*c* and 3*d* by the contact with transfer belt 11, extend the operating life of photosensitive drums 3*a*, 3*b*, 3*c* and 3*d*, and obtain the improved image quality.

Next, a third embodiment of this invention will be explained. This third embodiment differs from the first embodiment described above in the structure of memory disturbing brush member and all others are the same as those in the first embodiment. Therefore, the same structural elements as those in the first embodiment will be assigned with the same reference numerals and the detailed explanations thereof will be omitted here.

Figure 8:
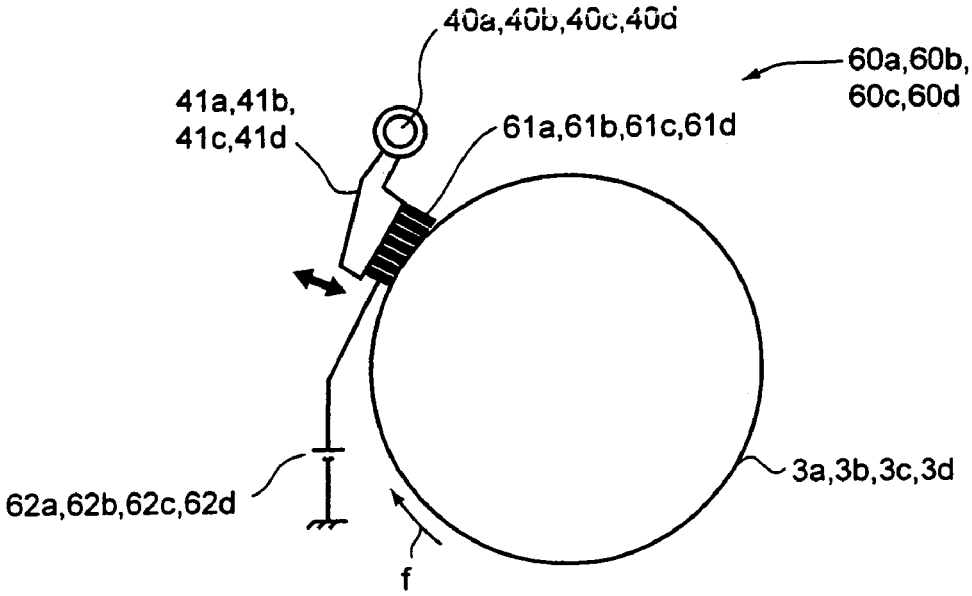
FIG. 8 is a schematic construction diagram showing a memory disturbing brush in the third embodiment of this invention.

In this embodiment, brush members 61*a*, 61*b*, 61*c* and 61*d* of memory disturbing brushes 60*a*, 60*b*, 60*c* and 60*d* shown in FIG. 8 are formed with carbon dispersed conductive brushes. Further, bias in reverse polarity to toner charge, generating no discharge is applied to brush members 61*a*, 61*b*, 61*c* and 61*d* from DC power sources 62*a*, 62*b*, 62*c* and 62*d*. In this embodiment, electrified charge of toners is in negative polarity and therefore, +300V bias is applied to brush members 61*a*, 61*b*, 61*c* and 61*d*.

As a result, in the image forming process, when disturbing transfer toners remaining on photosensitive drums, the ends of brush members are always kept in contact with photosensitive drums 3*a*, 3*b*, 3*c* and 3*d* without causing the "bent-portion contacts". At the same time, brush members 61*a*, 61*b*, 61*c* and 61*d* becomes able to adsorb toners remaining on photosensitive drums 3*a*, 3*b*, 3*c* and 3*d* electrostatically.

According to this embodiment, by the brushing effect and the electrostatic adsorbing effect of the ends of brush members 61*a*, 61*b*, 61*c* and 61*d*, it becomes possible to thoroughly disturb the remaining toners, surely prevent the generation of the filming phenomenon and obtain high-grade toner images without void.

Further, in this embodiment, bias applied to brush members 61*a*, 61*b*, 61*c* and 61*d* is not restricted and for example, bias in the same polarity as charge of toners can be applied. Thus, the charge of disturbed toners is made uniform by charging remaining toners again and by passing toners through brush members 61*a*, 61*b*, 61*c* and 61*d*, the cleaning effect in the developing unit can be increased. Further, pulse bias may be applied by repetitively turning ON/OFF bias that is applied to brush members 61*a*, 61*b*, 61*c* and 61*d*. Thus, it becomes possible to further increase the disturbing effect by giving the pulse vibration to the remaining toners in addition to the brushing effect by the ends of brush members 61*a*, 61*b*, 61*c* and 61*d*.

Next, a fourth embodiment of this invention will be explained. This fourth embodiment differs from the first embodiment described above in that the structure of memory disturbing brushes differs from that in the first embodiment but all other elements are the same as those in the first embodiment. Therefore, the same component elements of this fourth embodiment will be assigned with the same reference numerals as those explained in the first embodiment and the detailed explanations thereof will be omitted here.

Figure 9:
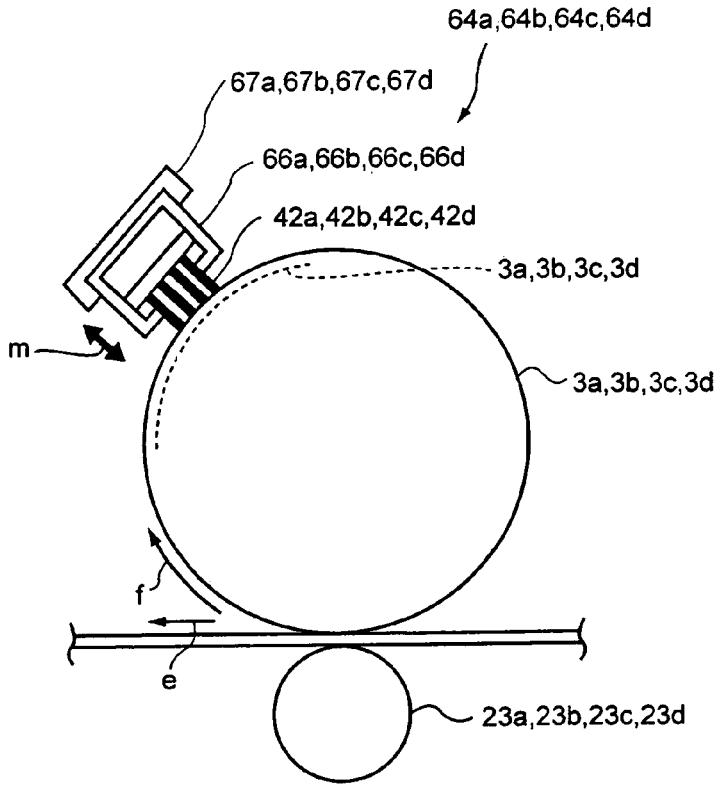
FIG. 9 is a schematic construction diagram showing a memory disturbing brush in the fourth embodiment of this invention.

Memory disturbing brushes 64*a*, 64*b*, 64*c* and 64*d* of this embodiment are supporting brush members 42*a*, 42*b*, 42*c* and 42*d* in holders 66*a*, 66*b*, 66*c* and 66*d* that are position adjusting means movably in the direction to contact with photosensitive drums 3*a*, 3*b*, 3*c* and 3*d* as shown in FIG. 9. Brush members 42*a*, 42*b*, 42*c* and 42*d* arranged so that the ends of acrylic fabrics are always in contact with photosensitive drums 3*a*, 3*b*, 3*c* and 3*d* by empty weight.

Figure 10:
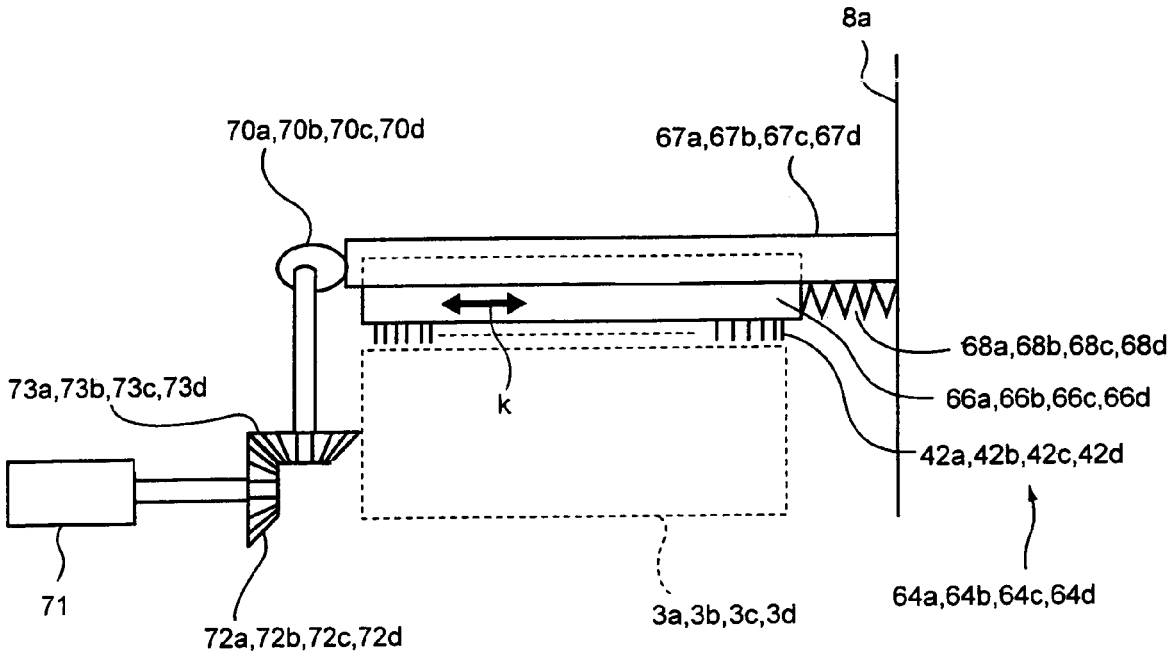
FIG. 10 is a schematic explanatory diagram showing the movement of a holder in the fourth embodiment of this invention.
Figure 11:
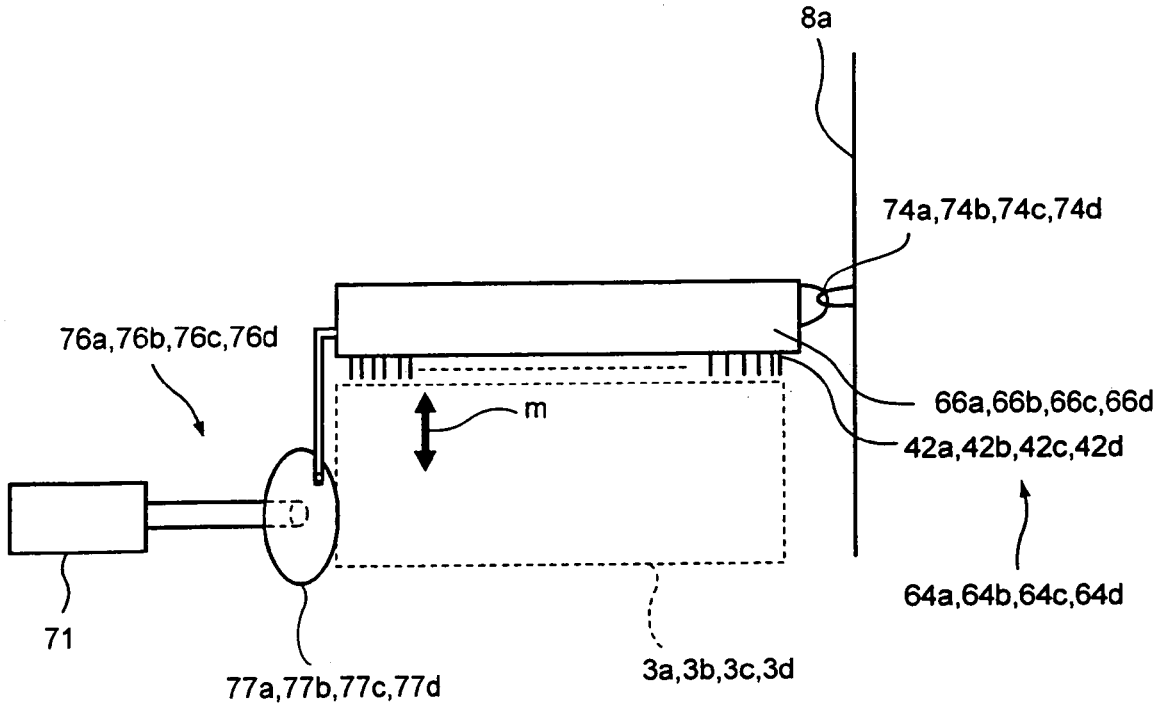
FIG. 11 is a schematic explanatory diagram showing the movement of a holder in the fifth embodiment of this invention.

Holders 66*a*, 66*b*, 66*c* and 66*d* are able to slide in the axial direction of photosensitive drums 3*a*, 3*b*, 3*c* and 3*d* that is the ends of brush members 42*a*, 42*b*, 42*c* and 42*d* reciprocates along guide rails 67*a*, 67*b*, 67*c* and 67*d* provided to the main body frame 8*a* as shown in FIG. 10. There are springs 68*a*, 68*b*, 68*c* and 68*d* at one side between the main body frame 8*a* and holders 66*a*, 66*b*, 66*c* and 66*d*. At the other sides of holders 66*a*, 66*b*. 66*c* and 66*d*, cams 70*a*, 70*b*, 70*c* and 70*d* to which the driving power of a motor 71 from the main body of the apparatus is transmitted are brought to contact.

The driving power is transmitted to cams 70*a*, 70*b*, 70*c* and 70*d* by a link mechanism that meshes first trapezoidal gears 72*a*, 72*b*, 72*c* and 72*d* provided to the shaft at the motor 71 side with second trapezoidal gears 73*a*, 73*b*, 73*c* and 73*d* provided to the shaft at cam 70*a*, 70*b*, 70*c* and 70*d* side by 90°.

Holders 66*a*, 66*b*, 66*c* and 66*d* are moved reciprocally in the arrow direction k along guide rails 67*a*, 67*b*, 67*c* and 67*d* by the rotation of cams 70*a*, 70*b*, 70*c* and 70*d* and the compression force of springs 68*a*, 68*b*, 68*c* and 68*d*.

Accordingly, when disturbing transfer toners remaining on photosensitive drums 3*a*, 3*b*, 3*c* and 3*d* in the image forming process, when the surfaces of photosensitive drums 3*a*, 3*b*, 3*c* and 3*d* are displaced to the positions shown by the dotted line from the positions shown by the solid line in FIG. 9, brush members 42*a*, 42*b*, 42*c* and 42*d* are moved in the contacting direction of the arrow direction m according to the displacement of the surfaces of photosensitive drums 3*a*, 3*b*, 3*c* and 3*d* in holders 66*a*, 66*b*, 66*c* and 66*d*, by empty weight.

As a result, the ends of brush members 42*a*, 42*b*, 42*c* and 42*d* always contact with photosensitive drums 3*a*, 3*b*, 3*c* and 3*d* without causing the "bent-portion contacts" of the acrylic fabric. Accordingly, while photosensitive drums 3*a*, 3*b*, 3*c* and 3*d* pass through memory disturbing brushes 49*a*, 49*b*, 49*c*, 49*d*, the remaining transfer toners are certainly disturbed by the brushing effect of the ends of brush member 42*a*, 42*b*, 42*c* and 42*d*.

Further, as holders 66*a*, 66*b*, 66*c* and 66*d*, are reciprocating in the arrow direction k by the rotation of cams 70*a*, 70*b*, 70*c*, 70*d* during this period, remaining toners are more certainly disturbed by brush members 42*a*, 42*b*, 42*c* and 42*d* that are supported and move reciprocating in the arrow direction k. In particular, when the carriers adhered on photosensitive drums 3*a*, 3*b*, 3*c* and 3*d* are attached to brush members 42*a*, 42*b*, 42*c* and 42*d*, if brush members do not reciprocate in the arrow direction k, photosensitive drums 3*a*, 3*b*, 3*c* and 3*d* might be scraped in the streak shape and adversely affect images.

However, even when carriers are attached to brush members 42*a*, 42*b*, 42*c* and 42*d*, the shaving of photosensitive drums 3*a*, 3*b*, 3*c* and 3*d* can be dispersed by reciprocating brush members 42*a*, 42*b*, 42*c* and 42*d* in the arrow direction k and further, it becomes possible to shake off carriers to photosensitive drums 3*a*, 3*b*, 3*c* and 3*d* sides by reciprocating brush members 42*a*, 42*b*, 42*c* and 42*d* again and pass in the direction of developing units 9*a*, 9*b*, 9*c* and 9*d*.

According to this embodiment, by bringing brush members 42*a*, 42*b*, 42*c* and 42*d* in contact with photosensitive drums 3*a*, 3*b*, 3*c* and 3*d*, and make them movable in the contact direction in holders 66*a*, 66*b*, 66*c* and 66*d*. Further, holders 66*a*, 66*b*, 66*c* and 66*d* are slid in the axial direction of photosensitive drums 3*a*, 3*b*, 3*c* and 3*d*. Accordingly, likewise the first embodiment described above, it is possible to thoroughly disturb remaining toners by the brushing effect of the ends of brush members 32*a*, 42*b*, 42*c* and 42*d*, surely prevent generation of the filming phenomenon and obtain a high-grade toner image without void. Further, it becomes possible to prevent the generation of flaws on the surfaces of photosensitive drums 3*a*, 3*b*, 3*c* and 3*d* by carriers attached to brush members 42*a*, 42*b*, 42*c* and 42*d*, improve image quality and extend the operation life of photosensitive drums 43*a*, 3*b*, 3*c* and 3*d*.

Next, a fifth embodiment of this invention will be explained. This fifth embodiment differs from the above-mentioned fourth embodiment in the moving direction of the holders and all others are the same as those in the fourth embodiment. Therefore, in this fifth embodiment, the same structural elements as those in the above fourth embodiment will be assigned with the same reference numerals and the detailed explanations thereof will be omitted.

In this embodiment, spindles 74*a*, 74*b*, 74*c* and 74*d* provided at one side of holders 66*a*, 66*b*, 66*c* and 66*d* are attached rotatably to the main body frame 8*a*. At the other sides of holders 66*a*, 66*b*, 66*c* and 66*d*, crank mechanisms 76*a*, 76*b*, 76*c* and 76*d* are attached for reciprocating holders 66*a*, 66*b*, 66*c* and 66*d* in the moving direction of photosensitive drums 3*a*, 3*b*, 3*c* and 3*d*. Crank mechanism 76*a*, 76*b*, 76*c* and 76*d* convert the driving power of motor 71 from the main body side of the apparatus into the reciprocating motion by cranks 77*a*, 77*b*, 77*c* and 77*d* and transmit to holders 66*a*, 66*b*, 66*c* and 66*d*.

Thus, holders 66*a*, 66*b*, 66*c* and 66*d* are oscillated in the moving direction of photosensitive drums 3*a*, 3*b*, 3*c* and 3*d* with spindles 74*a*, 74*b*, 74*c* and 74*d* as the supporting points.

Accordingly, in the image forming process, brush members 42*a*, 42*b*, 42*c* and 42*d* move by empty weight in the contacting direction in the arrow direction m according to the displacement of the surfaces of photosensitive drums 3*a*, 3*b*, 3*c* and 3*d* in holders 66*a*, 66*b*, 66*c* and 66*d*.

As a result, likewise the above-mentioned embodiment, the ends of brush members 42*a*, 42*b*, 42*c* and 42*d* are always brought in contact with photosensitive drums 3*a*, 3*b*, 3*c* and 3*d* and able to disturb remaining toners thoroughly by the high brushing effect.

Further, during this period, holders 66*a*, 66*b*, 66*c* and 66*d* are oscillated in the moving direction of photosensitive drums 3*a*, 3*b*, 3*c* and 3*d* by crank mechanisms 76*a*, 76*b*, 76*c* and 76*d*. Therefore, especially when carrier adhered on photosensitive drums 3*a*, 3*b*, 3*c* and 3*d* are attached to brush members 42*a*, 42*b*, 42*c* and 42*d*, the shavings of photosensitive drums 3*a*, 3*b*, 3*c* and 3*d* by carrier can be dispersed and furthermore, it is possible to shake off carrier to photosensitive drums 3*a*, 3*b*, 3*c* and 3*d* sides again and pass the drums in the direction of developing units 9*a*.

According to this embodiment, brush members 42*a*, 42*b*, 42*c* and 42*d* are brought to contact with photosensitive drums 3*a*, 3*b*, 3*c* and 3*d* and made movable in the contacting direction by empty weight in holders 66*a*, 66*b*, 66*c* and 66*d*. Further, holders 66*a*, 66*b*, 66*c* and 66*d* are reciprocated in the moving direction of photosensitive drums 3*a*, 3*b*, 3*c* and 3*d*. Accordingly, likewise the above-mentioned fifth embodiment, it is possible to thoroughly disturb remaining toners by the efficient brushing effect by the ends of brush members 42*a*, 42*b*, 42*c* and 42*d*, prevent the generation of the filming phenomenon and obtain a high-grade toner image without void. Further, it is also possible to prevent the generation of flaws on the surfaces of photosensitive drums by carrier attached on brush members 42*a*, 42*b*, 42*c* and 42*d*, improve the image quality and extend the life of photosensitive drums 3*a*, 3*b*, 3*c* and 3*d*.

Next, a sixth embodiment of this invention will be explained. This sixth embodiment differs from the above-mentioned fourth embodiment in the memory disturbing brush arranged positions. The same structural elements as those explained in the fourth embodiment are assigned with the same numerals and the detailed explanations thereof will be omitted here.

Figure 12:
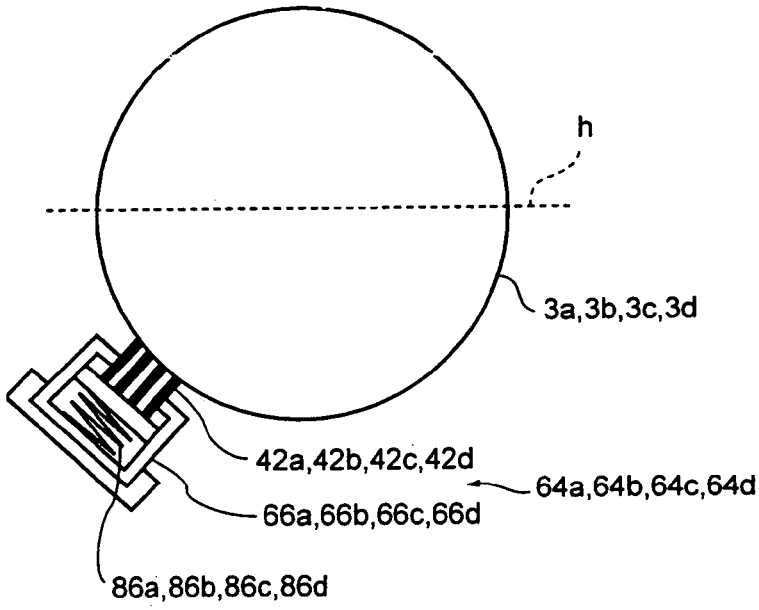
FIG. 12 is a schematic construction diagram showing a memory disturbing brush in the sixth embodiment of this invention.

Memory disturbing brushes 64*a*, 64*b*, 64*c* and 64*d* in this embodiment are arranged below the horizontal line n passing through the rotational center of photosensitive drums 3*a*, 3*b*, 3*c* and 3*d* as shown in FIG. 12. In holders 66*a*, 66*b*, 66*c* and 66*d*, springs 86*a*, 86*b*, 86*c* and 86*d* are provided between holders 66*a*, 66*b*, 66*c* and 66*d* and brush members 42*a*, 42*b*, 42*c* and 42*d*. Springs 86*a*, 86*b*, 86*c* and 86*d* bring brush members 42*a*, 42*b*, 42*c* and 42*d* to contact with photosensitive drums 3*a*, 3*b*, 3*c* and 3*d* at weights almost same as empty weights of brush members 42*a*, 42*b*, 42*c* and 42*d*.

Thus, when the surface positions of photosensitive drums 3*a*, 3*b*, 3*c* and 3*d* are displaced, brush members 42*a*, 42*b*, 42*c* and 42*d* oscillate in holders 66*a*, 66*b*, 66*c* and 66*d* according to the displacement of the surfaces of photosensitive drums 3*a*, 3*b*, 3*c* and 3*d*, and able to always bring their ends to contact with photosensitive drums 3*a*, 3*b*, 3*c* and 3*d*. Accordingly, the remaining toners on photosensitive drums 3*a*, 3*b*, 3*c* and 3*d* are thoroughly disturbed by the brushing effect of the ends of brush members 42*a*, 42*b*, 42*c* and 42*d*.

According to this embodiment, brush members 42*a*, 42*b*, 42*c* and 42*d* are compressed by springs 86*a*, 86*b*, 86*c* and 86*d* and the ends of brush members 42*a*, 42*b*, 42*c* and 42*d* are brought to contact with photosensitive drums 3*a*, 3*b*, 3*c* and 3*d* at a weight almost same as an empty weight. As a result, brush members 42*a*, 42*b*, 42*c* and 42*d* are able to keep the acrylic fabric ends always in contact with photosensitive drums 3*a*, 3*b*, 3*c* and 3*d*, thoroughly disturb remaining toners by brushing efficiently by the ends of brush members 42*a*, 42*b*, 42*c* and 42*d* and surely preventing the generation of the filming phenomenon, obtain high-grade toner images without voids.

Next, a seventh embodiment of this invention will be explained. In this seventh embodiment, a carrier removing device is provided around photosensitive drums for removing impurities such as carrier, etc. attached on photosensitive drums in the above-mentioned first embodiment. Memory disturbing brushes are in at structure differing from that in the first embodiment and all others are the same as those in the first embodiment. Therefore, the same structural elements as those explained in the first embodiment will be assigned with the same reference numerals and the detailed explanations thereof will be omitted here.

Figure 13:
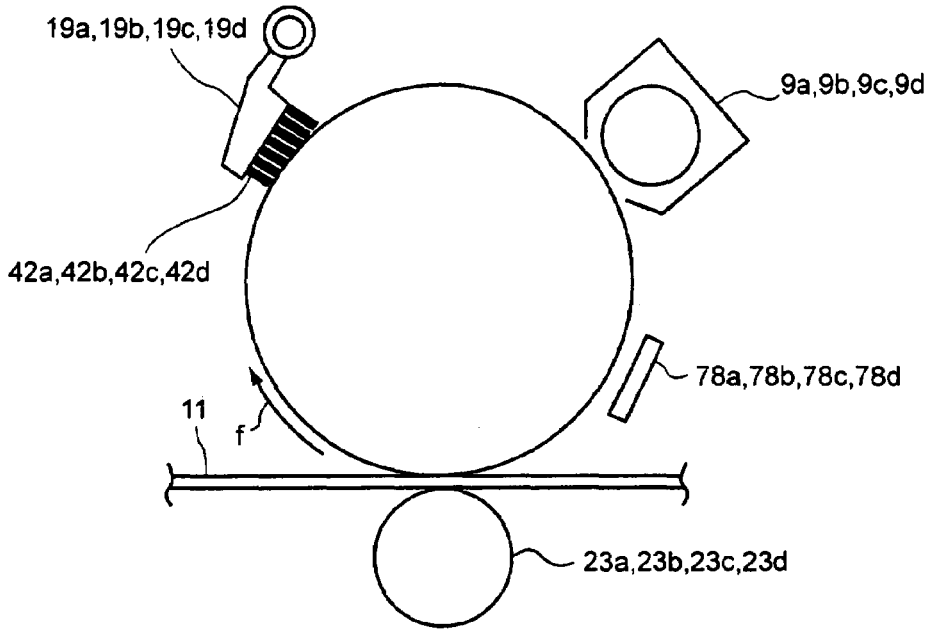
FIG. 13 is a schematic construction diagram showing a magnet of a holder in the seventh embodiment of this invention.

In this embodiment, magnets 78*a*, 78*b*, 78*c* and 78*d* that are impurity adsorbing means to remove carriers mixed in toners and adhered to photosensitive drums 3*a*, 3*b*, 3*c* and 3*d* are provided between developing units 9*a*, 9*b*, 9*c* and 9*d* around photosensitive drums and transfer belt 11 as shown in FIG. 13.

Magnets 78*a*, 78*b*, 78*c* and 78*d* are able to magnetically remove carrier attached to photosensitive drums 3*a*, 3*b*, 3*c* and 3*d*, their magnetic forces are optional. Further, to prevent carrier deposited on magnets 78*a*, 78*b*, 78*c* and 78*d* from touching the surfaces of photosensitive drums 3*a*, 3*b*, 3*c* and 3*d*, it is desirable to keep them away from the surfaces of photosensitive drums 3*a*, 3*b*, 3*c* and 3*d* by about 1~2 mm. However, magnets 78*a*, 78*b*, 78*c* and 78*d* are cleaned to prevent carrier to deposit during the maintenance, it is optional to provide magnets 78*a*, 78*b*, 78*c* and 78*d* more close to photosensitive drums 3*a*, 3*b*, 3*c* and 3*d*.

Further, magnets 78*a*, 78*b*, 78*c* and 78*d* may be provided at optional positions, for instance, at the downstream of the transfer position. However, when the magnets are provided at the upper stream of the transfer position as in this embodiment, the generation of flaws at the nip between photosensitive drums 3*a*, 3*b*, 3*c* and 3*d* and transfer belt 11 can be prevented.

According to this embodiment, likewise the first embodiment described above, it is possible to thoroughly disturb remaining toners by efficiently brushing with the ends of brush members 42*a*, 42*b*, 42*c* and 42*d*, surely prevent the generation of the filming phenomenon and obtain high-grade toner images without void. Further, even when carriers are attached to photosensitive drums 3*a*, 3*b*, 3*c* and 3*d* in the developing process, the carriers are absorbed and removed before the transfer by magnets 78*a*, 78*b*, 78*c* and 78*d*. Therefore, it is possible to prevent the generation of flaws on the surface of photosensitive drums 3*a*, 3*b*, 3*c* and 3*d* by carriers during the transfer or the image memory disturbing, obtain improved image quality and extend life of photosensitive drums 3*a*, 3*b*, 3*c* and 3*d*.

Next, an eighth embodiment of this invention will be explained. In this eighth embodiment, the development is made using a one-component developing unit in the above-mentioned first embodiment. Therefore, in this eighth embodiment, the same reference numerals are assigned to the same structural elements as those explained in the first embodiment and the detailed explanations thereof are omitted.

Figure 14:
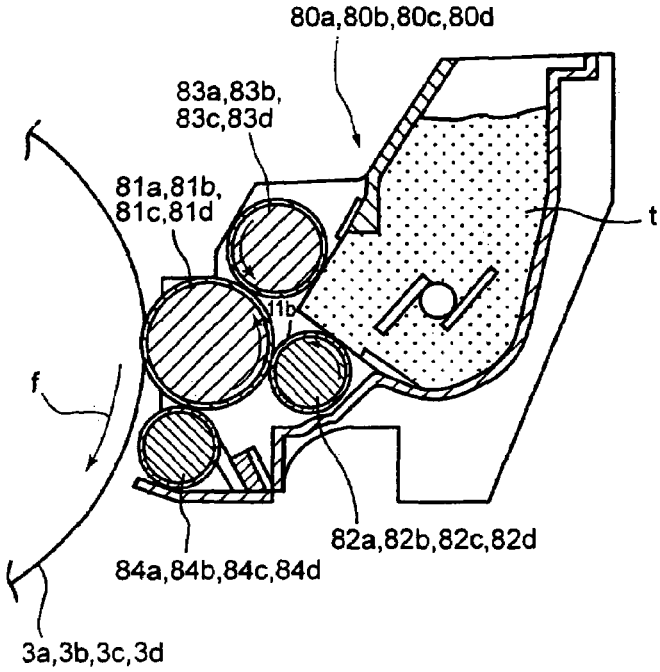
FIG. 14 is a schematic construction diagram showing one-component developing unit in the eighth embodiment of this invention.

In this embodiment, developing units 80*a*, 80*b*, 80*c* and 80*d* shown in FIG. 14 are provided for the simultaneous developing and cleaning on photosensitive drums 3*a*, 3*b*, 3*c* and 3*d* using toners that are non-magnetic one-component developing agents in yellow (Y), magenta (M), cyan (C), and black (BK), respectively at the downstream side of exposure units 7*a*, 7*b*, 7*c* and 7*d* in the vicinity of photosensitive drums 3*a*, 3*b*, 3*c* and 3*d*.

Developing units 80*a*, 80*b*, 80*c* and 80*d* are made of silicon rubber, urethane rubber, etc. and have developing rollers 81*a*, 81*b*, 81*c* and 81*d* to which DC voltage is applied. In the vicinity of developing rollers 81*a*, 81*b*, 81*c* and 81*d*, first supply rollers 82*a*, 82*b*, 82*c* and 82*d* and second supply rollers 83*a*, 83*b*, 83*c* and 83*d* that charge toner t and supply to developing rollers 81*a*, 81*b*, 81*c* and 81*d* are in contact with each other and rotated and further, recovery rollers 84*a*, 84*b*, 84*c* and 84*d* to recover toner t on developing rollers 81*a*, 81*b*, 81*c* and 81*d* are in contact with each other and rotated.

Developing rollers 81*a*, 81*b*, 81*c* and 81*d* have a nip of about 1 to 4 mm from photosensitive drums 3*a*, 3*b*, 3*c* and 3*d* and at the same time of forming toner images by supplying toner to the electrostatic latent image exposing portions on photosensitive drums 3*a*, 3*b* 3*c* and 3*d*, recover toners remaining on the non-exposure portions of a preceding toner image in developing rollers 81*a*, 81*b*, 81*c* and 81*d* and perform the simultaneous developing and cleaning. That is, in this embodiment, the image forming process is the same as that in the first embodiment described above although using non-magnetic one-component developing agents as developers.

Therefore, according to this embodiment, transfer toners remaining on photosensitive drums 3*a*, 3*b*, 3*c* and 3*d* are disturbed thoroughly by the efficient brushing effect by the ends of brush members 42*a*, 42*b*, 42*c* and 42*d*, the generation of the filming phenomenon is prevented and a high-grade toner image without void can be obtained. Furthermore, the development is made using non-magnetic one-component developing agents, the improved image quality is obtained and the life of photosensitive drums 3*a*, 3*b*, 3*c* and 3*d* can be extended without the possibility of generation of flaws on the surfaces of photosensitive drums 3*a*, 3*b*, 3*c* and 3*d* by carrier.

Further, this invention is not restricted to the embodiments described above but can be modified variously within the scope of the invention. For example, when an image forming apparatus uses developing units for making the simultaneous developing and cleaning, its construction is not limited and a monochromatic image forming apparatus is usable and colors of developing agents used are optional. For example, a tandem type image forming apparatus can be such that toner images are transferred in a lump on a recording medium after superposed on a middle transfer belt. Further, the shape, material, etc. of brush members are not restricted if their contacting directions are displaced corresponding to variation in image carriers and image memory on the image carriers can be disturbed. Further, brush members may be separated from the surfaces of image carriers when not operated.

According to this invention as described above, in an image forming apparatus using developing units performing the simultaneous developing and cleaning, it is possible to surely prevent the generation of the filming phenomenon and obtain high-grade toner images by increasing the brushing effect by always keeping the ends of brush members in contact with image memory toners remaining on the image carriers and disturbing image memory toners thoroughly.

What is claimed is:

1. An image forming apparatus, comprising:

an image carrier;

latent image forming means for forming an electrostatic latent image on the image carrier;

developing means for developing the electrostatic latent image to obtain a toner image and performing a cleaning at the same time;

transferring means for transferring the toner image formed on the image carriers onto a recording medium;

a brush means to disturb a remaining toner on the image carrier by contacting an end of the brush means with the surfaces of the image carrier after passing the transferring means; and position adjusting means for adjusting a displacement of the brush means to the surfaces of the image carrier so as to position the end of the brush means to a first position and a second position to the surfaces of the image carrier, wherein the position adjusting means displaces the brush means movably in a contacting direction to the image carrier surface and movably in an axial direction of the image carrier and the remaining toner which was disturbed by the brush means is recovered into the developing means, the recovery of the remaining toner constitutes the cleaning.

2. The image forming apparatus as claimed in claim 1 further comprising:

magnetic impurity adsorbing means, facing to the image carriers and provided between the developing means and the transferring means, for adsorbing and removing magnetic impurities attached to the image carriers.

3. The image forming apparatus as claimed in claim 1, wherein the developing means forms the toner image on the image carrier using one-component developing agent.

4. The image forming apparatus as claimed in claim 1, wherein the position adjusting means has a supporting member to support the brush means so that the brush means can slide in the contacting direction, and slide the brush means by empty weight of the brush means along the supporting member.

5. The image forming apparatus as claimed in claim 1, wherein the position adjusting means has a supporting member to support the brush means so that the brush means can slide in the contacting direction and a spring member to press an end of the brush means to the image carrier surface at a pressing force almost equal to the contacting force to the image carrier surface by an empty weight of the brush means and slide the brush means along the supporting member against the pressing force of the spring member according to the displacement of the image carrier surface.

6. The image forming apparatus as claimed in claim 1, wherein the position adjusting means has a rotatable arm to which the brush means is attached and the arm is rotated by an empty weight of the brush means.

7. The image forming apparatus as claimed in claim 1, wherein the position adjusting means has a rotatable arm to which the brush means is attached and a spring member to press the end of the brush means against the image carrier surface at a pressing force almost equal to the contacting force of the brush means to the image carrier surface by an empty weight of the brush means, and the arm is rotated against the spring member according to the displacement of the image carrier surface.

8. The image forming apparatus as claimed in claim 1 further comprising:

bias applying means for applying a bias voltage to the brush means.

9. The image forming apparatus as claimed in claim 1, wherein Young's modulus of brush fabrics of the brush means is in the range of 1,700 to 3,700 N/mm$^2$.

10. The image forming apparatus as claimed in claim 1, wherein the transfer means includes a transfer belt and a transfer brush to apply voltage to the transfer belt, and bring the transfer belt or the recording medium to contact the image carrier when transferring the toner image onto the recording medium.

11. An image forming method, comprising:

forming an electrostatic latent image on an image carrier;

developing the electrostatic latent image formed on the image carrier to obtain a toner image and at the same time recovenng toner attached on the image carrier to clean the image carrier;

transferring the toner image formed on the image carriers onto a recording medium;

disturbing toner remaining on the image carriers by a brush member kept in contact with the image carrier after the transferring; and displacing an end of the brush member in a direction moveably contacting with the image carrier and movably in an axial direction of the image carrier to adjust to at least a first position or a second position, wherein the remaining toner which was disturbed by the disturbing step is recovered the recovery of the toner constitutes the cleaning of the image carrier at the same time with developing.

12. The image forming method as claimed in claim 11, wherein the displacing is to adjust the end of the brush member either to the first position or the second position by an empty weight of the brush member.

13. The image forming method as claimed in claim 11, wherein the displacing is disturbing remaining toner at the first position or the second position by bringing the end of the brush member to contact the image carrier surface having residual toner after completing the transferring.

14. The image forming method as claimed in claim 11 further comprising:

adsorbing magnetically and removing magnetic impurities attached to the image carrier after completing the developing and before starting the transferring.

15. The image forming method as claimed in claim 11, wherein the developing and recovering are to develop the electrostatic latent image using one-component developing agent and simultaneously recover attached toner on the image camer.

16. The image forming method as claimed in claim 11, wherein the transferring is to transfer the toner image formed on the image carrier onto the recording medium by bringing the recording medium or a transfer belt to contact the image carrier using the transfer belt.

17. An image forming apparatus, comprising:

an image carrier;

a latent image forming unit configured to form an electrostatic latent image on the image carrier;

a developing unit configured to develop the electrostatic latent image to obtain a toner image and perform a cleaning at the same time;

a transfer unit configured to transfer the toner image formed on the image carriers onto a recording medium;

a memory disturbing brush configured to disturb a remaining toner on the image carrier by contacting an end of the brush with the surfaces of the image carrier after passing the transfer unit; and a position adjusting unit configured to adjust a displacement of the memory disturbing brush to the surfaces of the image carrier so as to position the end of the memory disturbing brush to a first position and a second position to the surfaces of the image carrier, wherein the position adjusting unit displaces the brush in a movably contacting direction to the image carrier surface and movably in an axial direction of the image carrier and the remaining toner which was disturbed by the memory disturbing brush is recovered into the developing unit, the recovery of the remaining toner constitutes the cleaning.

18. The image forming apparatus as claimed in claim 17 further comprising:

a magnet, facing to the image carrier and provided between the developing unit and the transfer unit, to adsorb and remove a magnetic impurity attached to the image carrier.

19. The image forming apparatus as claimed in claim 17, wherein the developing unit forms the toner image on the image carrier using one-component developing agent.

20. The image forming apparatus as claimed in claim 17, wherein the position adjusting unit has a supporting member to support the memory disturbing brush so that the memory disturbing brush can slide in a contacting direction, and slide the memory disturbing brush by empty weight of the memory disturbing brush along the supporting member.

21. The image forming apparatus as claimed in claim 17, wherein the position adjusting unit has a rotatable arm to which the memory disturbing brush is attached and the arm is rotated by an empty weight of the memory disturbing brush.

22. The image forming apparatus as claimed in claim 17, wherein Young's modulus of brush fabrics of the memory disturbing brush is in the range of 1,700 to 3,700 N/mm$^2$.

* * * * *